US006902650B2

(12) United States Patent
Park et al.

(10) Patent No.: US 6,902,650 B2
(45) Date of Patent: Jun. 7, 2005

(54) METHOD OF MAKING A STRATIFIED PAPER

(75) Inventors: Chang Shin Park, San Diego, CA (US); Hanjian Xu, Middletown, NY (US)

(73) Assignee: International Paper Company, Stamford, CT (US)

( * ) Notice: Subject to any disclaimer, the term of this patent is extended or adjusted under 35 U.S.C. 154(b) by 0 days.

(21) Appl. No.: 10/700,228

(22) Filed: Nov. 3, 2003

(65) Prior Publication Data

US 2004/0154775 A1 Aug. 12, 2004

Related U.S. Application Data

(60) Provisional application No. 60/423,266, filed on Nov. 1, 2002.

(51) Int. Cl.[7] ..... D21F 1/00; D21F 11/00

(52) U.S. Cl. ..... 162/216; 162/198; 162/259; 162/263; 209/155; 209/638; 209/210

(58) Field of Search ..... 162/216, 198, 162/259, 263; 209/155, 638, 210

(56) References Cited

U.S. PATENT DOCUMENTS

| | | | | |
|---|---|---|---|---|
| 3,853,694 A | | 12/1974 | Parker | |
| 4,141,788 A | | 2/1979 | Justus | |
| 4,526,653 A | * | 7/1985 | Andersson | 162/259 |
| 4,574,624 A | | 3/1986 | Lehtinent et al. | |
| 5,792,321 A | | 8/1998 | Aidun | |
| 5,803,270 A | | 9/1998 | Brodeur | |
| 5,876,564 A | | 3/1999 | Aidun | |
| 5,979,664 A | | 11/1999 | Brideur | |
| 6,136,152 A | | 10/2000 | Begemann | |

FOREIGN PATENT DOCUMENTS

| | | |
|---|---|---|
| EP | 0875622 A | 11/1998 |
| GB | 1577664 A | 10/1980 |

* cited by examiner

*Primary Examiner*—Mark Halpern

(57) ABSTRACT

The present invention provides a method making stratified paper by redistributing the pulp suspension inside the headbox nozzle using acoustic radiation waves. Acoustic radiation forces fractionate fibers based on fiber radius. The acoustic radiation waves separate the fibers by pushing the coarse and longer fibers to the inner area while fines and smaller fibers remain in the outer area. This has a similar effect of multi-layer stratification headbox, and provides paper with a smoother surface.

24 Claims, 8 Drawing Sheets

(0W)

(5W)

Acoustic radiation force

METHOD OF MAKING A STRATIFIED PAPER

This application benefits of Provisional application 60/423,266 filed on Nov. 1, 2002.

FIELD OF THE INVENTION

The present invention relates to improvements in paper making machines. More particularly the invention provides a novel method of making a stratified paper by separating wood pulp fibers located inside a headbox nozzle into various fractions based on fiber radius by means of acoustic radiation forces.

BACKGROUND OF THE INVENTION

In the papermaking process, a papermaking machine is used for making a fiber web, such as a paper web, from a fiber suspension. The fiber suspension is typically in the form of fibers that are suspended in water. The fiber suspension is introduced into a headbox, at the wet end of the machine. Headbox apparatuses of such type are disclosed in, for example, from U.S. Pat. No. 4,087,321.

The quality of paper and the board forming depends significantly upon the uniformity of the rectangular jet generated by the headbox. High quality typically means good formation, uniform basis weight profiles, uniform sheet structure and high sheet strength properties. These parameters are affected to various degrees by paper fiber distributions, fiber orientations, fiber density and the distributions of fines and fillers. Thus, separation or fractionation of fibers into two or more fractions that are relatively enriched in longer or shorter fibers is an important step of the papermaking process, because it allows for the efficient use of fiber properties. Fiber fractionation allows an optimized use of raw materials, increases production versatility, and contributes to waste and energy consumption reduction.

Various technologies have been devised during the past forty years to fractionate wood pulp fibers. Pressure screen systems, which fractionate fibers based on fiber length, are generally perceived as the most successful technology on a commercial standpoint. It is also known to place a vertical partition within a headbox for the purpose of deflocculating the fiber suspension. For example, a stratifying headbox or multi-layer headbox having a single headbox converging nozzle with a separate cross machine distribution channel for each layer is disclosed in U.S. Pat. No. 4,141,788 Each suspension package (layers) is separated throughout the headbox nozzle by means of sheets or plates. In multiple headbox forming, a number of headboxes are arranged so as to form a sheet that contains multiple layers.

Attempts to establish uniform paper stock flow in the headbox component, particularly the nozzle chamber, and to improve paper fiber orientation at the slice output of the headbox also include using a diffuser installed between the headbox distributor (inlet) and the headbox nozzle chamber (outlet). The diffuser block enhances the supply of a uniform flow of paper stock across the width of the headbox in the machine direction (MD). Such a diffuser box typically includes multiple conduits or tubular elements between the distributor and the nozzle chamber which may include step widening or abrupt opening changes to create turbulent flows for deflocculation or disintegration of the paper fiber stock to ensure better consistency of the stock. See for example, U.S. Pat. Nos. 5,792,321, 5,876,564, 6,153,057, 6,303,004, 6,406,595, 6,368,460, 6,425,984, 6,475,344, and published application no. US2002/0117285.

Further, it is known to place a mechanical device within the headbox for the purpose of agitating the fiber suspension and thereby deflocculating the fiber suspension. For example, a method for generating fine scale turbulence of the fibers within the stock as it passes through the headbox is disclosed in U.S. Pat. No. 3,853,694. The method consists of welding or soldering plate(s) on the inside wall of a flow channel or headbox, wherein the plate(s) is of such material and thickness that will vibrate due to the flow of stock past the plate, with the vibration being of a higher acoustic and super-acoustic range. Such vibration aids in the dispersion of fiber networks as it passes through the headbox. See also U.S. Pat. No. 6,136,152, which discloses a headbox that includes a turbulence insert.

The feasibility of using acoustic fractionation as a means of separating fibers is disclosed in U.S. Pat. Nos. 5,803,270 and 5,979,664. These patents disclose the use of a plane ultrasonic wave field to induce lateral deflections of moving fiber suspensions in a channel flow and thereby separate fibers into two separated streams.

However, none of the above patents teach or suggest a method that comprises a method for producing stratified paper by placing at least one ultrasound transducer in the headbox, so that sound waves pass transversely through the pulp discharge and thereby separate fibers in one stratified fiber suspension stream.

SUMMARY OF THE INVENTION

The present invention provides a method for making a stratified paper which method comprises continuously separating fibers inside the headbox into two or more fractions in one stratified fiber suspension stream. The described embodiments are based upon the use of acoustic wave fields (acoustic radiation forces) to induce deflections of the fibers causing agglomeration and reorientation of the fibers suspensions to separate the fibers inside the headbox nozzle chamber so that the fiber will be separated into two or more fractions according to the relative sizes of the fibers. Since the acoustic radiation force acting on the fibers is primarily a function of the fiber diameter or radius (i.e., fiber width), large radius fibers are more deflected than small radius fibers.

Thus, it is an object of the present invention to provide a method of making a three-ply stratified paper wherein the finer fibers are on the outside of the paper and the coarse fibers are sandwiched inside the paper.

It is a further object of the present invention to provide a method of making a two-ply stratified paper wherein the finer fibers are on one side of the paper and the coarse fibers are on the other side of the paper.

A feature of the present invention is to provide a method and mechanism for separating the fibers within the stock as it passes through the headbox.

Another feature of the present invention is to provide a method of redistributing pulp suspension inside the headbox nozzle by means of acoustic radiation forces.

A further feature of the present invention is to provide a method of separating dilute suspensions of fibers into plural fractions according to the relative fiber sizes of differing fibers.

A feature of the present invention is to generate radiation waves inside the headbox by means of placing at least one ultrasound transducer on the top wall of a headbox and at least one additional ultrasound transducer on the bottom wall of a headbox, so as to pushing the larger fibers of the paper pulp towards the middle, and leaving the smaller fibers on the outer surfaces of the discharge.

A feature of the present invention is to generate radiation waves inside the headbox by means of placing at least one ultrasound transducer on the top wall or the bottom wall of a headbox, so as to separate the fibers into large and smaller fibers.

A further feature of the present invention is to generate radiation waves inside the headbox by means of retrofitting a headbox with at least one ultrasound transducer.

Other advantages and features, as well as equivalent structures and methods which are intended to be covered hereby, will become more apparent with the teaching of the principles of the invention in connection with the disclosure of the preferred embodiments thereof in the specification, claims and drawings.

DETAILED DESCRIPTION OF THE INVENTION

Figure 1:
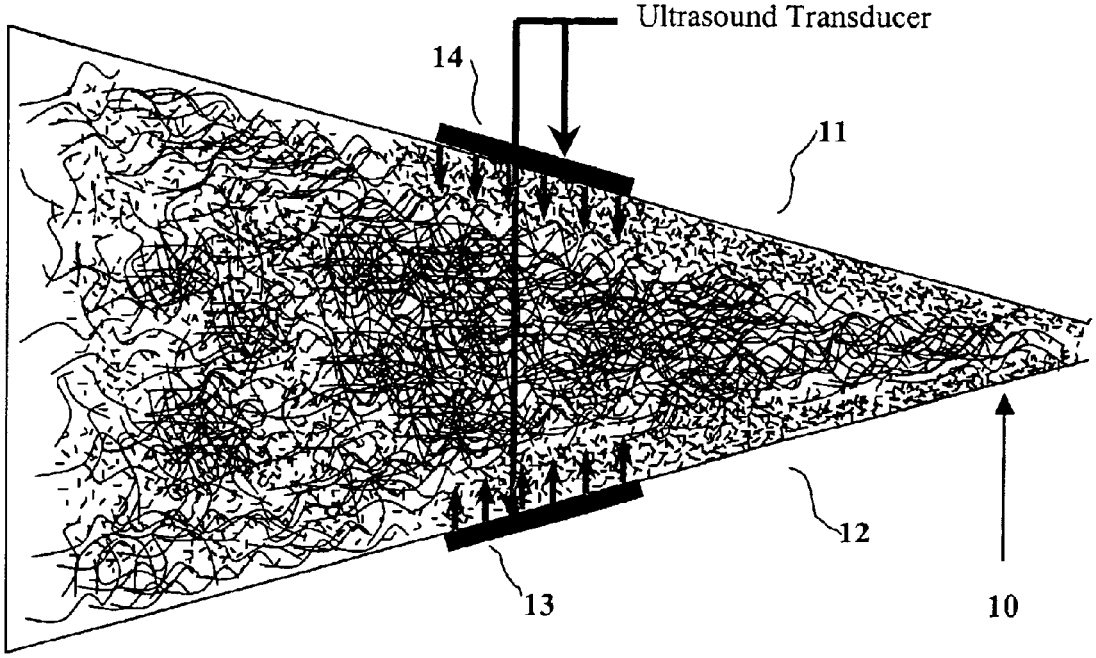
FIG. 1 shows a schematic view of acoustic stratifying headbox with two transducers on the walls of a headbox.

The particulars shown herein are by way of example and for purposes of illustrative discussion of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawings making apparent to those skilled in the art how the several forms of the invention may be embodied in practice.

The present invention provides a method of making a stratified paper comprising redistributing pulp suspension, inside the headbox nozzle, using acoustic radiation forces. More specifically, the method comprises placing at least one ultrasound transducer on the top and/or the bottom of the inside of a headbox or alternative replacing part of the wall of the headbox with an ultrasound transducer. The pulp suspension in said headbox is then subjected to acoustic radiation forces, causing the sound waves to pass transversely through the pulp discharge, and inducing deflections of the fibers in said fiber suspension thereby causing said fibers in said pulp suspension to separate into two or more fractions according to the relative sizes of the fibers in one stratified fiber suspension stream.

A plane progressive acoustic wave propagating through a fluid medium will generate an acoustic radiation pressure on a particle suspended in the fluid. The force exerted on the particle will be a function of the acoustic frequency, acoustic amplitude, speed of sound in the fluid, density of the fluid, density of the particle and shape of the particle. When two different particles, each with their own density and shape, are suspended in the fluid, there exists the possibility that the acoustic force exerted on each may be significantly different. These forces can generate sufficient difference in particle velocity and deflection angle such that one type of particle is separated from the other. The present invention uses this concept of acoustic stratification, to separate fibers based on the lengths and the diameters of fibers so as to improve sheet properties such as smoothness and bulk.

In the present invention the acoustic radiation force is used to stratify fibers into two or more fractions inside the headbox in one stratified fiber suspension stream. Ultimately, a multi-layer paper is attained using a single layer headbox. This results in more utilization of southern pine fibers; bulk preservation with good sheet smoothness; and optimization of filler and fine distribution. Thus, the end product is an acoustic stratifying headbox that provide similar effect of multi-layer stratification headbox.

Thus, the present invention provides a method for acoustic fiber fractionation using an ultrasonic wave field interacting with suspended fibers circulating in a headbox using acoustic radiation forces to separate fibers into two or more fractions based on fiber radius and length, with applications of the separation concept in the pulp and paper industry. The continuous process relies on the use of at least one transducer placed along the surface of the headbox, wherein the transducer selectively deflects flowing fibers as they penetrate the ultrasonic field.

A typical paper making machine normally comprises a "wet end" including a headbox, a wire (a "wire" is a fast-moving foraminous conveyor belt or screen) and a press section, a drying section, a size press, calender section and parent reel.

The fiber suspension of the present invention is typically in the form of wood fibers, preferably softwood such as southern pine fibers or hardwood, which are suspended in water. Softwood and hardwood fibers available from International Paper's Texarkana, Hwy 59 South, FM 3129, Texarkana, Tex. 75504 and Courtland mills, 16504 Country Road 150, Courtland, Ala. 35618, respectively. The fiber suspension may be treated before it is introduced into the headbox. For example, the fiber suspension may be cleaned and bleached prior to introduction into the headbox.

In an embodiment of the present invention, the acoustic radiation force is used to stratify coarse and larger fibers, such as southern pine fibers into the inner layer of sheet forming zone while fines, filler and smaller fibers, such as hardwood fibers, stay the outer layer, thereby forming a sandwich in which the smaller fibers are on the outside. In another embodiment of the present invention the fibers are separate into two layers of large and small fibers thereby producing a two-layer paper web such that one side is rough and the other is smooth.

The headbox may be any width depending on the paper machine. There are different types of headboxes used in the industry. However, there are some features that are common among all of these devices. The fiber suspension is introduced into the headbox at the wet end of a papermaking machine. A furnish is then discharged by the headbox (a "furnish" is predominantly water and stock) onto a wire which serves as a table to form the paper. As the furnish moves along, gravity and suction boxes under the wire draw the water out. The volume and density of the material and the speed at which it flow onto the wire determine the paper's final weight. Adjusting the pressure inside the headbox controls the speed of the jet leaving the headbox (or the flow rate inside the headbox). The forming jet velocity has a quite large effect on the fiber separation efficiency or separation depth.

Typically, after the paper leaves the "wet end" of the papermaking machine, it still contains a predominant amount of water. Therefore, the paper enters a press section, which can be a series of heavy rotating cylinders, which press the water from the paper, further compacting it and reducing its water content. Subsequent to pressing the paper enters a drying section. Typically hot air or steam-heated cylinders contact both sides of the paper, evaporating the water. The paper optionally passes through a sizing liquid to make it less porous and to help printing inks remain on the surface instead of penetrating the paper. The paper can go through additional dryers that evaporate the liquid in the sizing and costing. Calenders or polished steel rolls make the paper even smoother and more compact. The paper is then wound onto a parent reel and taken off the papermaking machine.

Figure 2:
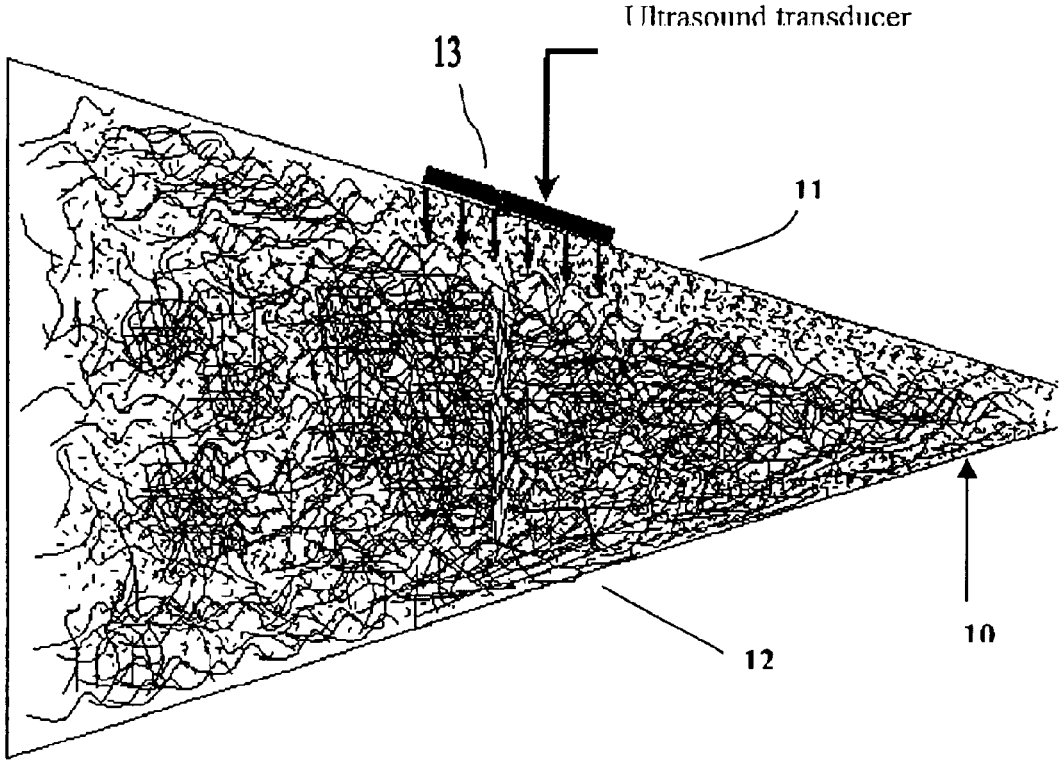
FIG. 2 shows a schematic view of acoustic stratifying headbox with one transducer on the wall of a headbox.

Describing now the drawings, it is to be understood that to simplify the showing thereof, only enough of the structure of the headbox apparatus for a papermaking machine has been illustrated therein as is needed to enable one skilled in the art to readily understand the underlying principles and concepts of this invention. FIGS. 1 and 2 shows the design concept for a schematic view of acoustic stratifying headbox 10. FIG. 1 shows one embodiment of the present invention wherein two acoustic transducers 13 and 14 are mounted on the walls 11 and 12 of the headbox 10. FIG. 2 shows another embodiment of the present invention wherein one acoustic transducer 13 is mounted along one of the outer wall of a headbox 10. In another embodiment multiple sonic transducers can be substantially evenly spaced on the outer walls of a headbox. The headbox may optionally be fitted with receivers to absorb the sound. In another embodiment the transducers are mounted on the top and/or the bottom of the inside of a headbox. In a further embodiment part of the wall of the headbox is replaced with an ultrasound transducer. In yet another embodiment, the headbox has at least one transducer and receiver to absorb the sound. In a further embodiment, the transducers and/or receivers may be retrofitted to the walls of the headbox.

The transducers are preferably installed all the way across the machine direction. Thus, depending on the size of the machine, several hundred or thousand such transducers may be required. Preferably the transducers are installed in series in the stream-wise direction. Preferably, the acoustic transducers have the dimension of 5 cm by 5 cm. However, it is to be understood that the acoustic transducers can have different dimensions. The same signal generator and signal amplifier can drive each sonic transducer and receiver. The power intensity is preferably in the range of 5 W/cm$^2$ to 100 W/cm$^2$ and most preferably it is 10 W/cm$^2$ or less. The acoustic transducers preferably have a frequency in the range of 20 kHz to 150 MHz and most preferably of 150 kHz or less.

According to the present invention, depending on the machine width, at least one acoustic transducer is mounted on the walls 11 and 12 of the headbox 10. A receiver may also be optionally mounted on the walls 11 and 12. The acoustic transducer is connected to and controlled by commercial available signal generator and ultrasound amplifier. The acoustic transducers are available from Sonic Concepts, Inc., 20018 163$^{rd}$ Avenue NE, Woodinville, Wash. 98072.

Of importance are at least four variables: acoustic intensity, pulp flow velocity, pulp consistency and frequency of the transducer. Preferably, the acoustic intensity is in the range of 0 W/cm$^2$ to 150 W/cm$^2$, the pulp flow rate is 0 m/s to 25 m/s, the pulp consistency is 0% to 2.0%, and the frequency of the transducer is 20 kHz to 150 MHz. All of the above variables will affect the stratified depth of the jet issued from the headbox slice, which will then further affect the percentage of paper or board covered with fine and short fibers in the thickness direction. The stratified depth of the jet issued from the headbox increases with acoustic intensity, and decreases with pulp suspension flow rate and pulp consistency. With the increase of frequency, the acoustic forces will increase and thus increase the stratified depth. However, with the increase of the frequency, there is also an increase in the attenuate rate of the acoustic power. This has the effect of reducing the travel distance of ultrasound in the pulp suspension and thus reducing the stratified depth.

The acoustic transducers provide sonic energy to the fiber suspension within the headbox so that sound waves pass transversely through the pulp discharge thereby pushing the larger fibers of the paper pulp towards the middle, and leaving the smaller fibers on the outer surfaces of the discharge. Where in this application the term "sonic" is used, it is to be understood that the term may include the meaning of the term "ultrasonic." That is, "sonic" may or may not include frequencies above 20 kHz. Sonic transducer 10 is preferably an ultrasonic transducer, emitting ultrasonic energy with a frequency above 20 kHz, so that a higher energy lever is transmitted into the fiber suspension.

EXPERIMENTAL SETUP

A vertical straight channel was used and exposed to the acoustic radiation pressure. The flow loop system including the flow channel, pump, drive controller and reservoirs were installed at the Institute of Paper Science and Technology. The channel width was reduced to increase the mean velocity and a small bleeding valve was installed to sample the fiber suspension under the acoustic radiation pressure. The flow channel was made out of Plexiglas for the visual investigation.

A Kodak High Motion Analyzer that records the dynamic events up to 1000 frames per second at 50 $\mu$sec shutter opening was used for visualization. All the images were recorded and saved into an optical disk in a Kodak bay file format. Then the bay file images were converted to a common image file format. Front light systems with 1000 W tungsten light were used. Due to short shutter opening time and high frame grabbing rate, it is necessary to use a strong and direct front lighting system.

As summarized in Table 1, the experiments were conducted at three different velocities, 0.5 m/sec, 1 m/sec and 2 m/sec, and used four different types of furnish at 0.25% and 0.5% consistencies.

TABLE 1

| | Furnish | Consistency | Flow Speed | Sampling | Imaging Remarks |
|---|---|---|---|---|---|
| 150 kHz Transducer | 100% Softwood | 0.25% | 0.5 m/sec | — | Yes |
| | | | 1.0 m/sec | — | Yes |
| | | | 2.0 m/sec | — | Yes |
| | | 0.5% | 0.5 m/sec | — | Yes |
| | | | 1.0 m/sec | — | Yes |
| | | | 2.0 m/sec | — | Yes |
| | 70% Softwood and 30% Hardwood | 0.25% | 0.5 m/sec | Yes | Yes |
| | | | 1.0 m/sec | Yes | Yes |
| | | | 2.0 m/sec | No | Yes |
| | | 0.5% | 0.5 m/sec | No | Yes |
| | | | 1.0 m/sec | No | Yes |
| | | | 2.0 m/sec | No | Yes |
| | 30% Softwood and 70% Hardwood | 0.25% | 0.5 m/sec | Yes | Yes |
| | | | 1.0 m/sec | Yes | Yes |
| | | | 2.0 m/sec | No | Yes |
| | | 0.5% | 0.5 m/sec | No | Yes |
| | | | 1.0 m/sec | No | Yes |
| | | | 2.0 m/sec | No | Yes |
| | 100% Hardwood | 0.25 | 0.5 m/sec | — | Yes |
| | | | 1.0 m/sec | — | Yes |
| | | | 2.0 m/sec | — | Yes |
| | | 0.5% | 0.5 m/sec | — | Yes |
| | | | 1.0 m/sec | — | Yes |
| | | | 2.0 m/sec | — | Yes |
| 1.5 MHz Transducer | 70% Softwood and 30% Hardwood | 0.25% | 0.5 m/sec | Yes | Yes |
| | | | 1.0 m/sec | Yes | Yes |
| | | | 2.0 m/sec | No | No |
| | | 0.5% | 0.5 m/sec | Yes | Yes |
| | | | 1.0 m/sec | Yes | Yes |
| | | | 2.0 m/sec | No | No |

EXAMPLE 1

Comparison of High Frequency and Low Frequency Transducers

Figure 3A:
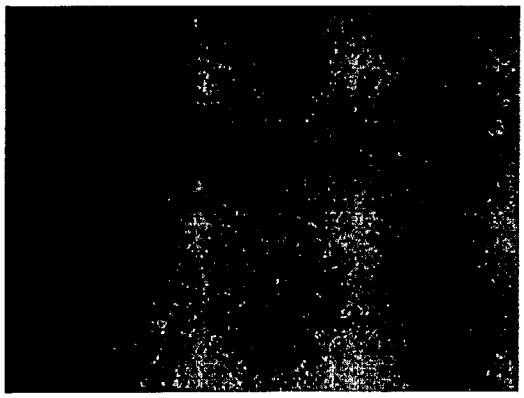
FIG. 3A shows the stratification of fibers using acoustic power of 0 W.
Figure 3B:
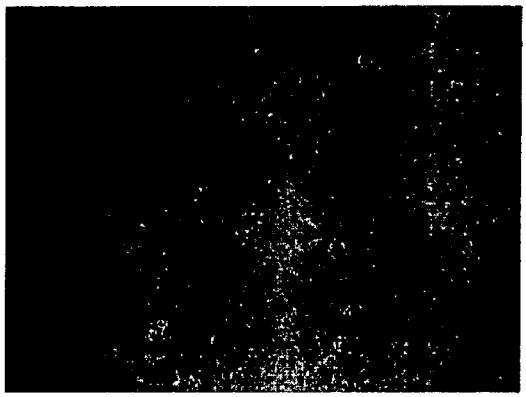
FIG. 3B shows the stratification of fibers using acoustic power of 5 W.
Figure 3C:
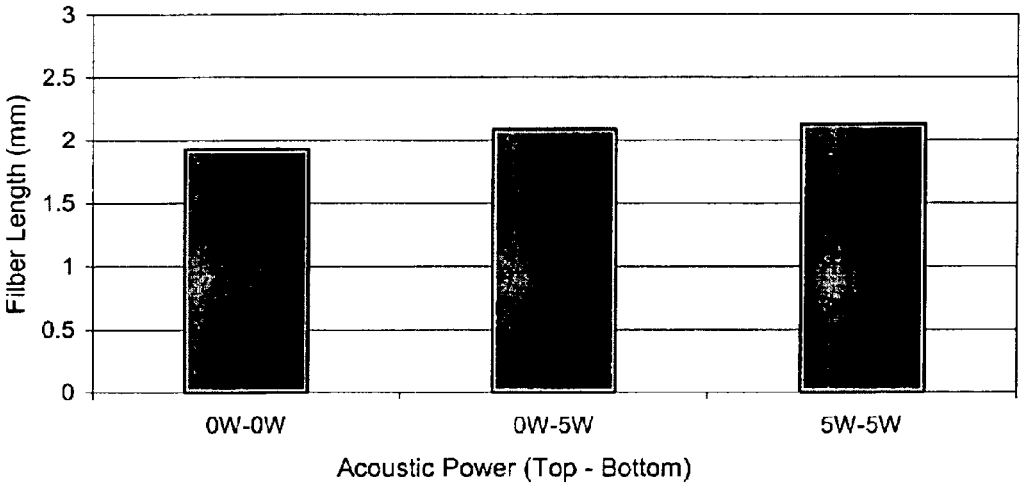
FIG. 3C summarizes the results of the comparison between low and high frequency transducers in the determining the most effective frequency range for acoustic transducers.

Both high frequency (150 kHz) and low frequency (1.5 MHz) acoustic transducers were evaluated. Both high and low frequency transducers were systematically compared to determine the most effective frequency range of the acoustic transducer. As the result of the evaluation, the lower frequency (150 kHz) transducer showed significant stratification based on fiber length and diameter, while the higher frequency (1.5 MHz) transducer didn't show major stratification. Presently, only 150 kHz transducers were used. The result is summarized in FIGS. 3A–3C. As shown in FIGS. 3A–3C there is no difference between acoustic powers of 0 W and acoustic powers of 5 W. This indicates that the high frequency transducer is not effective for fiber suspension stratification and fractionation. This may be potentially due to the extremely high attenuation rate of the acoustic power in the flowing medium.

EXAMPLE 2

Visualization Study of Acoustic Stratification

The following conditions were used in this experiment: (1) Rectangular channel flow (5 cm×3 m); (2) High Speed Digital Imaging Device (records the dynamic events at 1000 frames per second); (3) Front lighting method (the light stands in front of camera but behind the visualized object). Flow velocity: 0.5 m/sec (about 100 feet/min); Consistency: 0.25–0.28%; Acoustic Power: 10 W/cm$^2$.

Figure 5A:
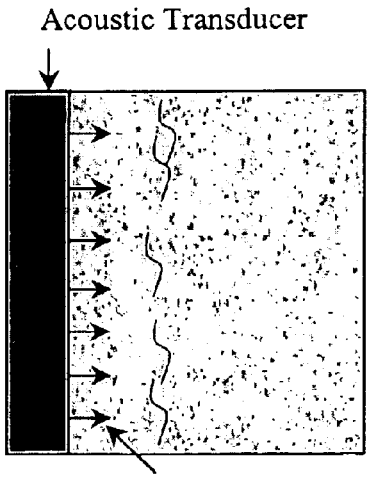
FIG. 5A depicts a visualization study of acoustic stratification forces and its effect on fibers.
Figure 5B:
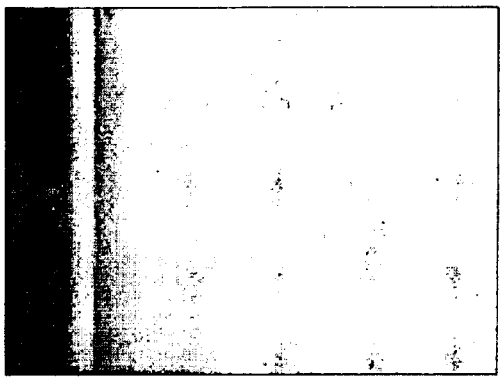
FIG. 5B shows the deflection activity for 100% hardwood fibers.
Figure 5C:
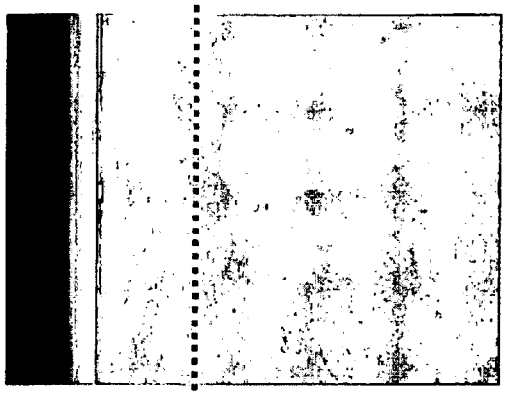
FIG. 5C shows deflection activity for 100% softwood fibers.
Figure 5D:
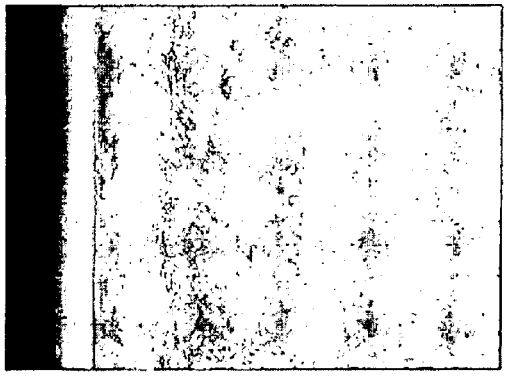
FIG. 5D shows the fiber stratification for hardwood and softwood mixtures consisting of 70% softwood fiber and 30% hardwood fiber.
Figure 5E:
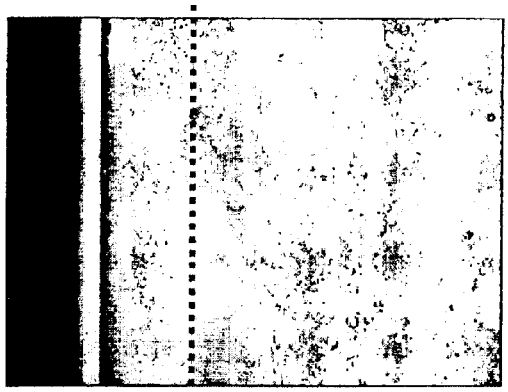
FIG. 5E shows the fiber stratification for hardwood and softwood mixtures consisting of 30% softwood fiber and 70% hardwood fiber.

As predicted, the acoustic radiation force acts selectively on certain types of fibers. As shown on FIG. 5B, there was no activity observed for 100% hardwood fibers. In contrast, 100% softwood fiber suspension was strongly deflected due to the acoustic force (FIG. 5C). The fiber stratification was observed for hardwood and softwood mixtures consisting of 70% softwood fiber and 30% hardwood fiber (FIG. 5D) and 30% softwood fiber and 70% hardwood fiber (FIG. 5E). The depth of the stratification depicted as the dotted line in FIGS. 5C and 5E is the critical parameter to evaluate the feasibility of the concept.

Figure 6:
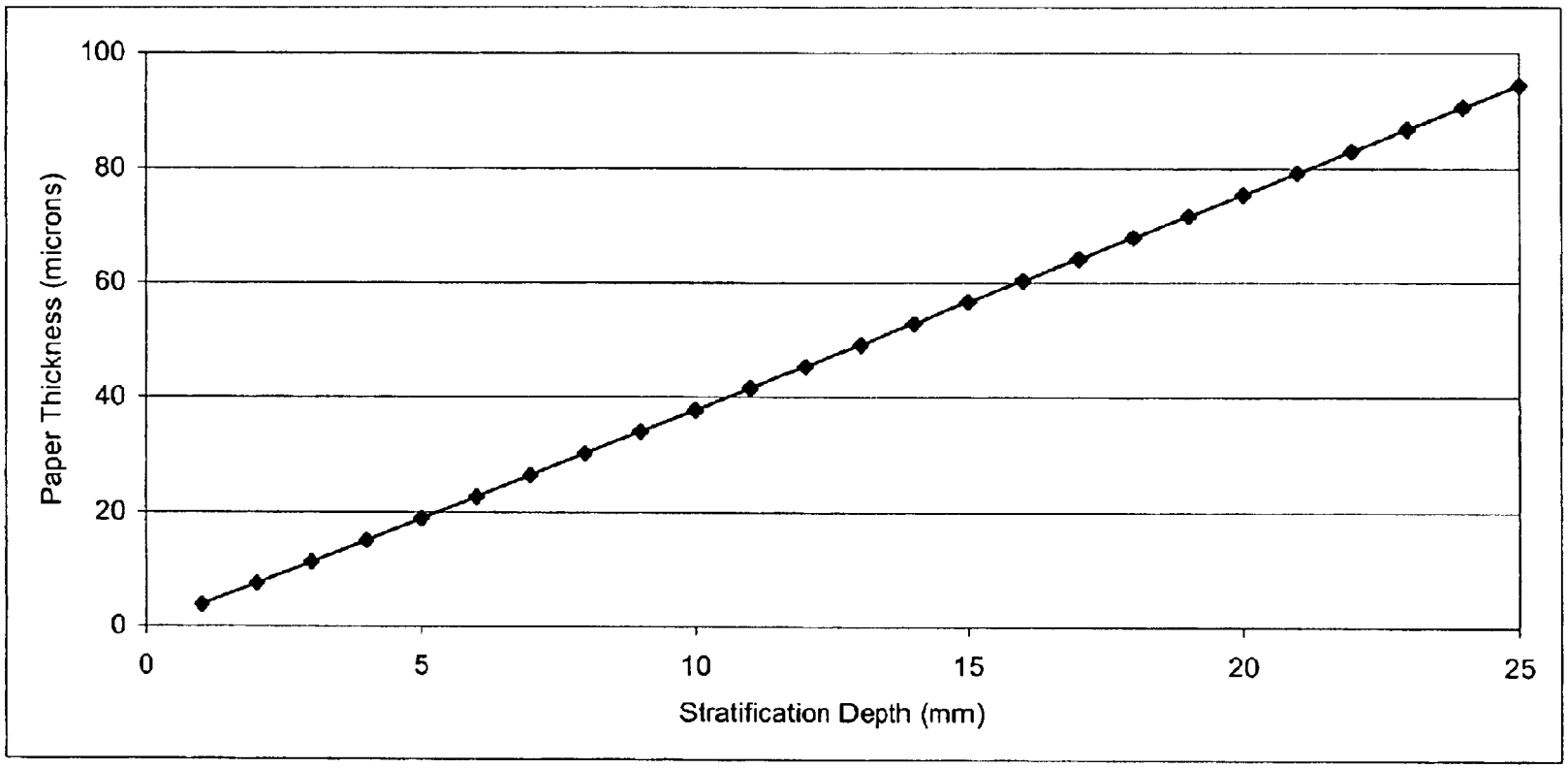
FIG. 6 shows the relationship between the stratification depth and the paper thickness.

The stratification depth should be large enough to cover the surface with layers of hardwood fibers to improve the smoothness. Data in FIG. 6 are based on assumption that the thickness of a paperboard has a thickness of 305 $\mu$m and the slice opening of the headbox is 2.25 inches. The relationship between the stratification depth and its contribution to the paper thickness is shown in FIG. 6. In order to obtain a smooth surface, three or four layers of hardwood fiber or fine must cover the paperboard surface. In other words, the thickness of the paperboard results from the top part of the stratified jet should be about 40 $\mu$m. Looking at FIG. 6 one can deduce that the stratified depth of the jet should be more than 10 mm so that there will be enough hardwood fibers and fines to cover the surface of the paperboard.

Figure 4:
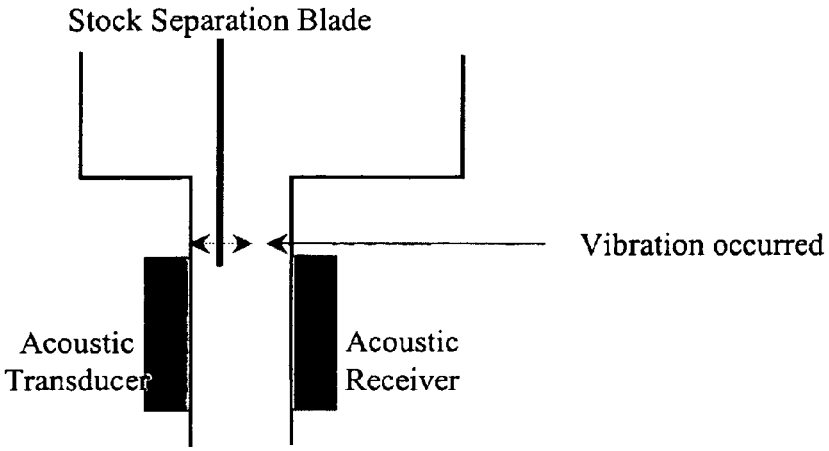
FIG. 4 shows the stock separation blade setup to collect the stock under the acoustic radiation pressure.

As shown in FIG. 4, the stratification depth ranged from 4 to 6 mm because the stock separation blade caused the pressure buildup around the transducer. The backpressure buildup reduced the stratification depth. After the stock separation blade was removed, the stratification depth increased up to 15 mm. This experiment shows that acoustic forces can create a stratification layer deep enough so that the final paper product can have a smooth surface.

EXAMPLE 3

Figure 7:
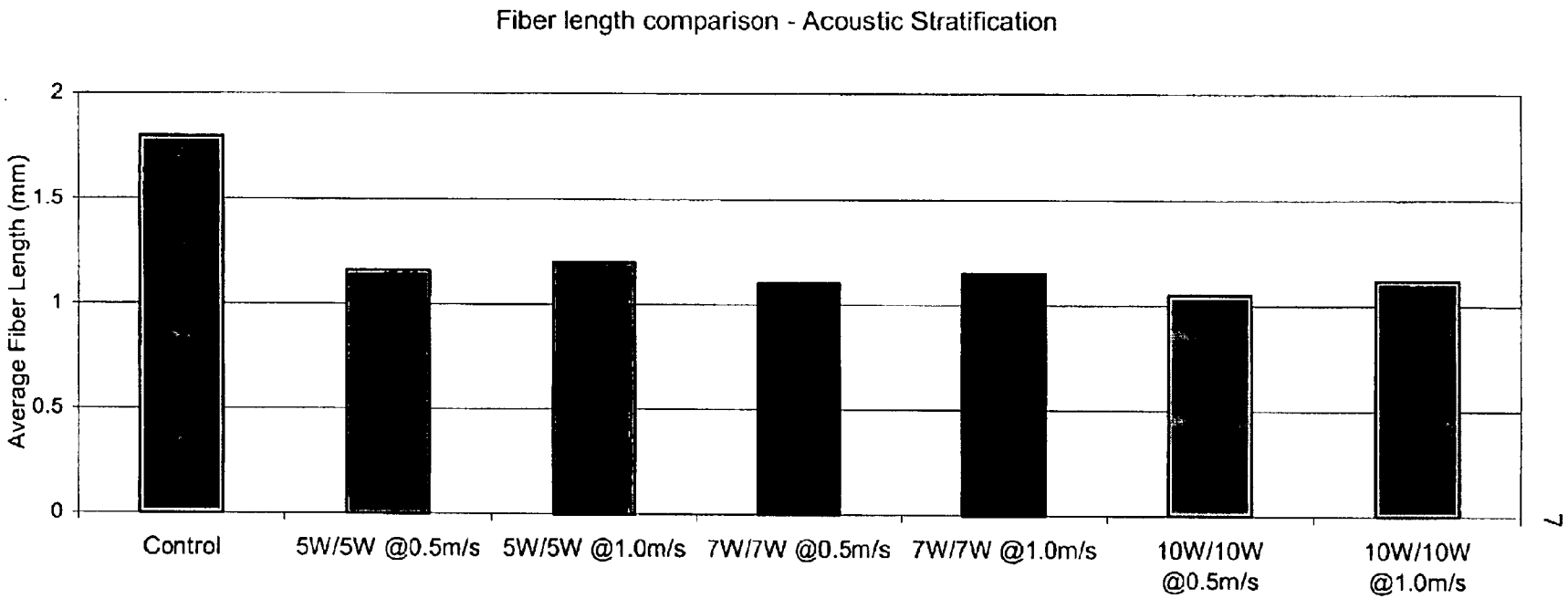
FIG. 7 shows that the average fiber length of the suspension collected under the acoustic radiation pressure was lower than the suspension without the acoustic pressure.
Figure 8:
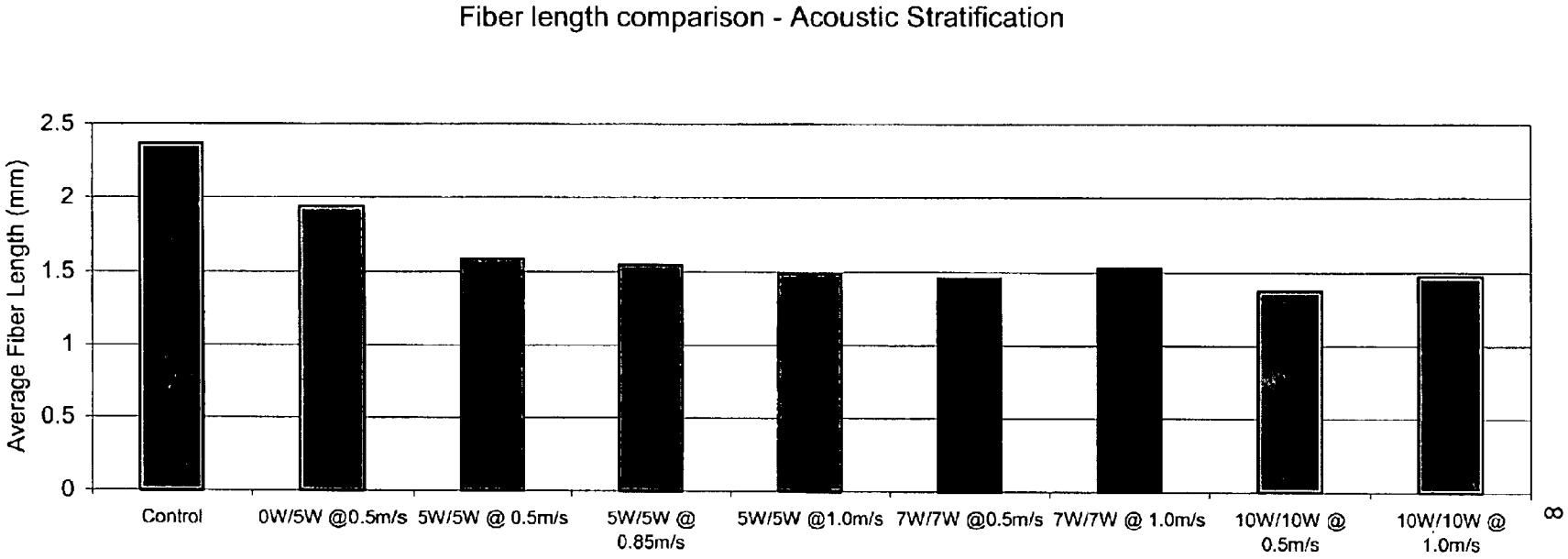
FIG. 8 shows that the average fiber length of the suspension collected under the acoustic radiation pressure was lower than the suspension without the acoustic pressure.

Weight averaged fiber length were used as a parameter to evaluate the effectiveness of the stratification. Because the amount of long softwood fibers reduces under the acoustic radiation pressure, the overall average fiber length should decrease. In FIGS. 7 and 8 uses 70:30 (hardwood:softwood) mixtures, and the control has no acoustic power (feeding suspension). As shown in FIGS. 7 and 8, the average fiber length of the suspension collected under the acoustic radiation pressure was lower than the suspension without the acoustic pressure. This clearly indicated that the acoustic radiation pressure separates a considerable amount of long fibers from the incoming suspension. The result agrees with the visual observation.

It is noted that the foregoing examples have been provided merely for the purpose of explanation and are in no way to be construed as limiting of the present invention. While the invention has been described with reference to a preferred embodiment, it is understood that the words, which have been used herein, are words of description and illustration, rather than words of limitation. Changes may be made, within the purview of the appended claims, as presently stated and as amended, without departing from the scope and spirit of the invention in its aspects. Although the invention has been described herein with reference to particular means, materials and embodiments, the invention is not intended to be limited to the particulars disclosed herein; rather, the invention extends to all functionally equivalent structures, methods and uses, such as are within the scope of the appended claims.

What is claimed is:

1. A method of making a stratified paper comprising the steps of:

(a) introducing a pulp fiber suspension into a headbox of a paper making machine, said which-headbox comprising a single layer zone and having at least one ultrasonic means in proximity to said single layer zone;

(b) subjecting said pulp suspension inside the single layer zone of the headbox to acoustic radiation forces produced by said ultrasonic means;

(c) causing the pulp suspension in the single layer zone to separate into two or more fractions according to the relative sizes of the fibers;

(d) depositing said pulp suspension onto a wire; (e) draining said pulp suspension; and (f) drying said pulp suspension.

2. The method of claim 1 wherein said ultrasonic means is an ultrasonic transducer.

3. The method of claim 2 wherein the transducer has a frequency in the range of 20 kHz to 150 MHz.

4. The method of claim 1 wherein said ultrasonic means is mounted on the top wall of the inside of the single layer zone of the headbox.

5. The method of claim 1 wherein said ultrasonic means is mounted on the bottom wall of the inside of the single layer zone of the headbox.

6. The method of claim 1 wherein said ultrasonic means is mounted on the top and the bottom wall of the inside of the single layer zone of the headbox.

7. The method of claim 1 wherein the wall of the single layer zone of said headbox is replaced with an ultrasound transducer.

8. The method of claim 1 wherein the pulp suspension forms a pulp stream having one region rich in smaller fibers and another region rich in course fibers.

9. The method of claim 1 wherein the pulp suspension forms a pulp stream having one region rich in fine fibers and another rich in course fibers that is sandwiched inside the fine fibers.

10. The method of claim 1, further comprising a source of electrical power connected to and configured to energize said ultrasonic means.

11. The method of claim 1, further comprising at least one receiver.

12. The method of claim 1 wherein the acoustic radiation forces in the range of 0 $W/cm^2$ to 150 $W/cm^2$.

13. A method of making a stratified paper comprising the steps of:

(a) introducing a pulp fiber suspension into a single layer headbox of a paper making machine, which headbox has at least one ultrasonic means;

(b) subjecting said pulp suspension inside the headhox to acoustic radiation forces produced by said ultrasonic means;

(c) causing the pulp suspension to separate into two or more fractions according to the relative sizes of the fibers;

(d) depositing said pulp suspension onto a wire;

(e) draining said pulp suspension; and (f) drying said pulp suspension.

14. The method of claim 13 wherein said ultrasonic means is an ultrasonic transducer.

15. The method of claim 14 wherein the transducer has a frequency in the range of 20 kHz to 150 MHz.

16. The method of claim 13 wherein said ultrasonic means is mounted on the top wall of the inside of the headbox.

17. The method of claim 13 wherein said ultrasonic means is mounted on the bottom wall of the inside of the headbox.

18. The method of claim 13 wherein said ultrasonic means is mounted on the top and the bottom wall of the inside of the headbox.

19. The method of claim 13 wherein the wall of said headbox is replaced with an ultrasound transducer.

20. The method of claim 13 wherein the pulp suspension forms a pulp stream having one region rich in smaller fibers and another region rich in course fibers.

21. The method of claim 13 wherein the pulp suspension forms a pulp stream having one region rich in fine fibers and another rich in course fibers that is sandwiched inside the fine fibers.

22. The method of claim 13, further comprising a source of electrical power connected to and configured to energize said ultrasonic means.

23. The method of claim 13, further comprising at least one receiver.

24. The method of claim 13 wherein the acoustic radiation forces in the range of O $W/cm^2$ to 150 $W/cm^2$.

* * * * *